US009469518B2

(12) United States Patent
Davis

(10) Patent No.: US 9,469,518 B2
(45) Date of Patent: Oct. 18, 2016

(54) DRIP CATCHER APPARATUS AND METHOD

(71) Applicant: Keith L. Davis, Tooele, UT (US)

(72) Inventor: Keith L. Davis, Tooele, UT (US)

( * ) Notice: Subject to any disclaimer, the term of this patent is extended or adjusted under 35 U.S.C. 154(b) by 57 days.

(21) Appl. No.: 14/463,520

(22) Filed: Aug. 19, 2014

(65) Prior Publication Data

US 2015/0053277 A1 Feb. 26, 2015

Related U.S. Application Data

(60) Provisional application No. 61/868,010, filed on Aug. 20, 2013.

(51) Int. Cl.
*B67D 1/16* (2006.01)

(52) U.S. Cl.
CPC ..... *B67D 1/16* (2013.01); *Y10T 137/0402* (2015.04)

(58) Field of Classification Search
CPC ..... B67D 1/16; Y10T 137/0402
USPC ..... 222/1, 108, 185.1; 4/658, 656; 137/15.01
See application file for complete search history.

(56) References Cited

U.S. PATENT DOCUMENTS

| | | | | |
|---|---|---|---|---|
| 163,481 | A | | 5/1875 | Gbay |
| 207,439 | A | | 8/1878 | Pflueger |
| 215,016 | A | | 5/1879 | Mettee |
| 217,133 | A | | 7/1879 | Meinen |
| 259,390 | A | | 6/1882 | Hensley |
| 457,458 | A | | 8/1891 | Britton |
| 555,820 | A | | 3/1896 | Kaup |
| 573,089 | A | | 12/1896 | Haynes |
| 699,481 | A | | 5/1902 | Boyd |
| 831,713 | A | | 9/1906 | Ferguson |
| 956,562 | A | | 5/1910 | Beers |
| 1,108,692 | A | | 8/1914 | Burd |
| D47,322 | S | | 5/1915 | Campbell |
| 1,256,206 | A | | 2/1918 | Cordley |
| 1,412,630 | A | | 4/1922 | Richard |
| 1,456,045 | A | | 5/1923 | Wilkin |
| 1,520,511 | A | | 12/1924 | Reymore |
| 1,660,074 | A | | 2/1928 | Hagg |
| 1,703,284 | A | | 2/1929 | Wolfe |
| 1,728,502 | A | * | 9/1929 | McGregor ..... A47L 19/02 4/656 |
| 1,746,792 | A | | 2/1930 | Rastetter |
| 1,942,340 | A | | 1/1934 | Madden |
| 2,054,485 | A | * | 9/1936 | Reeves ..... B67D 1/1405 141/362 |
| 2,144,004 | A | | 1/1939 | Wilson |
| 2,209,057 | A | | 7/1940 | Jackson |
| D123,472 | S | | 11/1940 | Caldwell |
| D163,481 | S | | 5/1951 | Rauh |
| 2,558,323 | A | | 6/1951 | Strun |
| 2,696,091 | A | | 12/1954 | de Campos Bueno |
| 2,763,880 | A | | 9/1956 | Mulcahy |
| D187,639 | S | | 4/1960 | Timmons |
| 2,991,912 | A | | 7/1961 | Thomas et al. |
| D193,191 | S | | 7/1962 | Taub |

(Continued)

FOREIGN PATENT DOCUMENTS

CA 2260352 A1 * 7/2000 ..... A47G 19/145

*Primary Examiner* — Donnell Long
(74) *Attorney, Agent, or Firm* — Pate Baird, PLLC

(57) ABSTRACT

An apparatus and method for collecting drips from a spout on a beverage dispenser has a table top base that is held in place by the weight of a beverage dispenser. The table top base supports a drip catch reservoir, and drips hit a back plate with guides before washing into the drip catch reservoir. The drip catch reservoir has an outlet allowing drainage into a disposal tank without moving the apparatus.

15 Claims, 10 Drawing Sheets

(56) References Cited

U.S. PATENT DOCUMENTS

| | | | | | |
|---|---|---|---|---|---|
| 3,115,251 | A | | 12/1963 | Farrell | |
| 3,131,711 | A | | 5/1964 | Delaney | |
| 3,199,820 | A | | 8/1965 | Thompson | |
| 3,204,830 | A | | 9/1965 | Harr | |
| 3,240,384 | A | | 3/1966 | Lermer | |
| D207,439 | S | | 4/1967 | Miller | |
| 3,317,167 | A | | 5/1967 | Becker et al. | |
| D215,016 | S | | 8/1969 | Flushing | |
| D220,637 | S | | 5/1971 | Swett | |
| 3,762,675 | A | | 10/1973 | Sankey | |
| 3,838,841 | A | | 10/1974 | Cadman | |
| 4,109,889 | A | | 8/1978 | Durket | |
| D250,621 | S | | 12/1978 | Blum | |
| 4,184,725 | A | | 1/1980 | Spangler | |
| 4,216,598 | A | | 8/1980 | Newbert | |
| D264,096 | S | | 4/1982 | Jones | |
| 4,369,948 | A | | 1/1983 | Krauss et al. | |
| 4,511,111 | A | | 4/1985 | Godfrey et al. | |
| D297,335 | S | | 8/1988 | Atwell | |
| 4,865,225 | A | | 9/1989 | Chavez | |
| 4,993,546 | A | * | 2/1991 | Southard | A47K 5/02 206/77.1 |
| 5,094,388 | A | * | 3/1992 | Chapman, Jr. | E03B 9/20 222/108 |
| D326,795 | S | | 6/1992 | Reitz et al. | |
| 5,165,574 | A | | 11/1992 | Ratcliffe | |
| 5,209,452 | A | | 5/1993 | Goldberg | |
| 5,279,007 | A | * | 1/1994 | Kolada | A47J 43/24 210/249 |
| 5,317,977 | A | | 6/1994 | Omessi | |
| 5,339,676 | A | | 8/1994 | Johnson | |
| 5,339,872 | A | | 8/1994 | Marino | |
| 5,390,714 | A | | 2/1995 | North, III et al. | |
| 5,470,011 | A | | 11/1995 | Jordan | |
| D379,050 | S | | 5/1997 | Kohanski | |
| 5,690,138 | A | | 11/1997 | Fuller | |
| D399,092 | S | | 10/1998 | Miller | |
| D401,111 | S | | 11/1998 | Leatherman | |
| D401,474 | S | | 11/1998 | Leatherman et al. | |
| D410,172 | S | | 5/1999 | Lalonde | |
| 5,960,995 | A | | 10/1999 | Leatherman et al. | |
| 6,105,816 | A | | 8/2000 | Shea | |
| 6,279,781 | B1 | * | 8/2001 | Konar | B67D 1/16 137/312 |
| 6,367,670 | B1 | | 4/2002 | Warner et al. | |
| 6,408,554 | B1 | | 6/2002 | Przylucki | |
| 6,565,899 | B1 | | 5/2003 | Cecere | |
| 6,679,400 | B1 | * | 1/2004 | Goodman | B67D 1/16 137/312 |
| 6,827,243 | B1 | | 12/2004 | Nuzzolese | |
| 7,216,778 | B2 | | 5/2007 | Kaeb | |
| D550,042 | S | | 9/2007 | Chapple | |
| D568,680 | S | | 5/2008 | Hsu | |
| D582,721 | S | | 12/2008 | Stange | |
| 7,992,586 | B1 | * | 8/2011 | Bovee | B67D 1/1256 137/312 |
| 8,172,111 | B1 | * | 5/2012 | Fowler | B67C 11/02 137/313 |
| 2006/0226172 | A1 | * | 10/2006 | Fowler | B67C 11/02 222/108 |
| 2008/0314936 | A1 | * | 12/2008 | Robinson | B67D 1/1416 222/509 |
| 2009/0140006 | A1 | * | 6/2009 | Vitantonio | B67D 1/0082 222/108 |
| 2009/0206110 | A1 | * | 8/2009 | Bianchini | A47K 5/08 222/192 |
| 2010/0065583 | A1 | * | 3/2010 | Leggett | B67D 1/16 222/108 |
| 2010/0083440 | A1 | * | 4/2010 | Spurlock | A47J 47/20 4/658 |

* cited by examiner

DRIP CATCHER APPARATUS AND METHOD

RELATED APPLICATIONS

This application claims the benefit of U.S. Provisional Patent Application Ser. No. 61/868,010, filed Aug. 20, 2013, which is hereby incorporated by reference in its entirety.

BACKGROUND

1. The Field of the Invention

This invention relates to liquid containment and, more particularly, to novel systems and methods for catching spills and drips from beverage dispensers.

2. The Background Art

Portable beverage containers allow for the economical refreshment of guests in areas that were not built with expensive, inflexible beverage dispensers. These portable beverage dispensers allow for a large variety of both cold and hot drinks to be served, and increase capacity and flexibility for change in beverage need.

Spouts drip. The spouts on beverage containers such as coffee pots and water jugs notoriously drip. Jostled cups filled close to the brim also spill over routinely. Attempts to manage these drips and spills have resulted in various drip trays existing in the prior art. Some existing drip trays must be moved to be emptied. Moving a drip tray that is filled with liquid is a delicate task because trays filled with liquids are easily spilled. Some existing drip trays require the beverage dispenser to be moved. Moving the beverage dispenser may be a difficult task.

The dripping and spilling leaves an unsightly mess which can be unsanitary, damage to flooring, and a result in liability due to the hazards of wet floors. The mess also results in additional work for staff maintaining the beverage dispensers.

Unfortunately, the spouts on these containers drip for a variety of reasons. Not the least of these reasoning is physics. The last few drops take longer to flow down that the filled cup remains below the spout. Various attempts have been made to address the leakage from beverage dispensers.

For example, a cloth, paper towel, dish, tray, or the like may be placed on the floor to intercept, absorb, or both, the liquid when it falls. Unfortunately, this is often causes splashing, unsightly, and may still overflow and damage flooring or present a tripping hazard. An alternative method of containing the leakage is to put a larger container, such as a bucket, on the floor. This solution still results in the drops splashing liquids onto the floor, as well as presenting a tripping hazard.

Several inventors have tried to improve the situation created by leaking beverage dispensers. Reitz, et al. disclosed a drip tray in U.S. Design Pat. No. D326,795 a tray supported by an anchor that is held in place by the weight of a beverage dispenser. Kaeb, U.S. Pat. No. 7,216,778, proposed an alternative design that suspends a collection device from the spout of the beverage dispenser. A third design, in Wang U.S. Design Pat. No. D630,471 S1, proposed a removable tray constructed as part of the beverage dispenser.

SUMMARY OF THE INVENTION

In view of the foregoing, in accordance with the invention as embodied and broadly described herein, a method and apparatus are disclosed in one embodiment of the present invention as including a drip catcher for collecting unintentionally released drops of liquid from the spout of beverage containers.

The present invention need not be moved to be drained. Instead, a waste container may be attached to a tray by a line to remove collected liquid, and the waste container may be removed and emptied without disturbing the beverage dispenser.

DETAILED DESCRIPTION OF THE PREFERRED EMBODIMENTS

Figure 1:
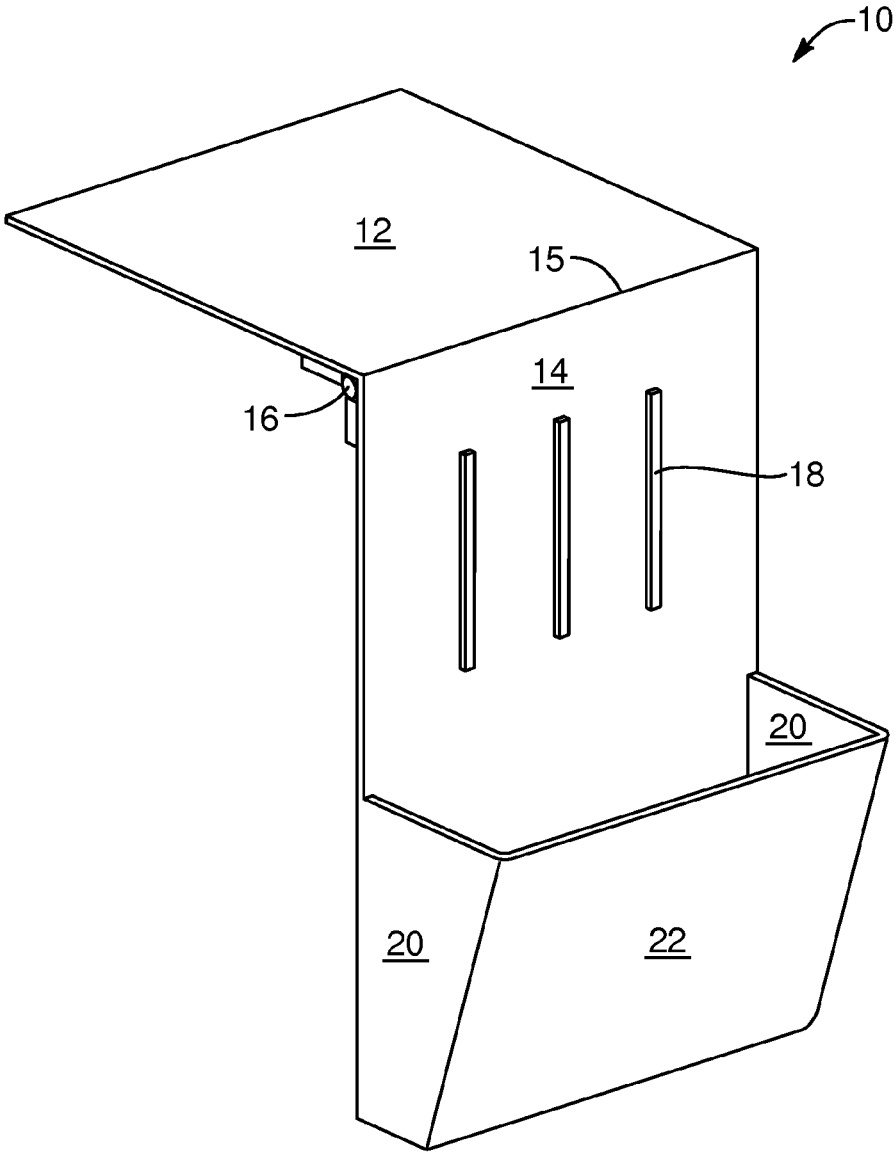
FIG. 1 is a front elevation view of one embodiment of a system including a base, back plate with guides, a baffle, and a reservoir to collect liquid released from a beverage dispenser.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of apparatus and methods in accordance with the invention. The illustrated embodiments will be best understood by reference to the drawings, wherein like parts are designated by like numerals throughout.

Referring to FIG. 1, a drip catcher 10 includes a base 12, and may include an optional hinge 16 or other mechanism connecting to a back plate 14 with several drip guides 18. The back plate 14 is connected to the side wall 20, the baffle 22, and the bottom 21 to form a drip collection reservoir 34. The base 12 may be any size or shape sufficient to secure the drip catcher 10, whether freely suspended or secured under the weight of the beverage dispenser 38.

The base 12 is placed on a table 42, typically underneath a beverage dispenser 38. The weight of the beverage dispenser 38 on the base 12 holds the drip catcher 10 in place by friction, and resists bumping, jostling, or the like. Clamping, adhesion, tacky contacts or the like may provide alternative securement. Absent a hinge 16, the base 12 may be permanently connected to the back plate 14 at a fixed angle to suspend the drip catcher 10 from the top surface when placed on a table 42.

The base 12 may be made of any one or more of a variety of materials. This may include plastic, rubber or other polymers metal, glass, porcelain, wood, or other material including coatings, composites, layers, liners, or the like capable of providing structural integrity. Also needed may be friction between sufficient friction between the table 42 and the beverage dispenser 38 to hold the drip catcher 10 in place during operation. In a typical embodiment, the base 12 need not require any form of adhesive material or fasteners such as glue, epoxy, tape, nails, or screws. The base 12 is placed on a table 42. Friction is simply a benefit against bumping or jostling due to handling by users. The natural friction of the base 12 and the table 42 is enhanced by the weight of the beverage dispenser 38 on the base 12 to hold the drip catcher 10 in place. A frictional material, such as a gripping rubber mat or other elastic polymer, or the like, may fit, contact, or coat the underside thereof.

The base 12 may be connected to the back plate 14 either permanently or separably, and with or without an optional hinge 16. To make it easier to clean the drip catcher 10, a separable joint may selectively slide or snap together and apart. Any number or types of hinges 16, or a continuous hinge 16, may connect the table top anchor 12 to the back plate 14 and guide 18. The hinge 16 may be made of any suitable, sufficiently strong material including an injection molded membrane of the base 12 material.

The connection of the base 12 to the back plate 14 may occur at and define an edge 15. The edge 15 may define a line about which to suspend the apparatus 10 from a table 42. The edge 15 may be formed with or without an optional hinge 16. When the hinge 16 is not present, a bend marking the transition from the base 12 to the back plate 14 will define the edge 15.

The hinge 16 may support the back plate 14 and guides 18 as they hang freely or rigidly beside the table 42, underneath a spout 40. Rigidity may be imposed by the table, a hinge 16 designed with sufficient friction, or both. The hinge 16 may be set to position the back plate 14 at a variety of different angles. The drip catcher 10 may be positioned in a variety of configurations with different tables 42 and beverage dispensers 38. The hinge 16 may adjust of the back plate 14 so that any drip from the beverage container strikes within the back plate 14 and guides 18 or lands in the reservoir 34.

In the event that the hinge 16 is not present, the base 12 may connect directly to the back plate 14 and provide a static angle between the base 12 and the back plate 14. A drip catcher 10 without a hinge 16 may be constructed for a specific application, including a specific size, height, shape, or the like of table 42 and beverage dispenser 38. A drip catcher 10 without a hinge 16 may also be selected for aesthetic purposes for events such as weddings, company parties, festivals and other occasions where appearance or branding are important. Likewise, a selectively separable, but rigid, joint 16 may serve in place of hinge 16.

The drip catcher 10 may be exposed to a variety of liquids, which may result in the collection of residue. The residue will require that the drip catcher 10 be cleaned periodically. A drip catcher 10 with hinges 16 or a detachable joint 16 may create a profile more easily accommodated by an automatic dishwasher. An automatic dishwasher may provide a more thorough, sanitary, simpler, and easier method of cleaning the drip catcher 10.

The back plate 14 and guides 18 may be formed in a variety of shapes, sizes, and materials. The back plate 14 will typically be constructed of a material sufficiently impervious that any liquid dripping from the spout 40 on the beverage dispenser 38 will not pass through the back plate 14. Dripping liquid from the spout 40 on the beverage dispenser 38 that strikes the back plate 14 with guides 18 will be drawn toward the reservoir 34 by gravity.

The back plate 14 may be angled by the hinges 16, by fixed construction, or both. The liquid droplets falling from the spout 40 strike the back plate 14 at an oblique, acute angle. The liquid droplets typically adhere by surface tension without splashing away. This angle creates additional spacing available when someone obtains a beverage from the beverage dispenser 38. The additional space (i.e., standoff) enhances access for a cup, thermos, mug, or other drinking container in that additional space. Additionally, when liquid drips from the spout 40, striking the back plate 14 is preferred of impact directly in to the liquid 36 or well 34. The splash effect of liquid 36 striking a horizontal surface of a quiescent pool of the same liquid 36 is greatly reduced or even eliminated. The oblique striking angle and position of the well 34 outward from the spout 40 may be selected to virtually eliminate the splashing, directing rivulets of liquid 36 downward along the back plate 14.

The guides 18 on the back plate 14 serve to direct and laterally restrain splashing or spreading of liquid 36 dripping from the spout 40. The surface tension of the liquid 36 with respect to the material of the back plate 14 will cause the liquid 36 to adhere to the back plate 14 and the guides 18. Gravity will cause the liquid 36 that adheres to the guide to draw toward the reservoir 34.

If a liquid 36 droplet is allowed to fall perpendicularly toward and strikes directly against a liquid 36 or solid surface, there is a tendency for the liquid 36 to crown or splash. The angle of impact against the back plate 14 and the surface tension may be calculated to eliminate or greatly reduce splashing. The guides 18 also serve to direct flow downward along the back plate. This tends to increase coalescence and flow of liquid 36 downward, which will reduce or eliminate any splash from liquid 36 that has previously fallen against the back plate 14.

As liquid 36 is drawn down the back plate 14 and guides 18 by gravity, it will eventually reach the bottom 21 of the reservoir 34 and may accumulate. The bottom 21 is connected to the back plate 14, side walls 20 and baffle 22 to form a reservoir 34. The reservoir 34 may collect a liquid 36 in transit until it is drained into a disposal tank 32. In some embodiments an array of internal, blade-like baffles or collimators, or even absorbent material may extend from the bottom 21 to capture liquids 36, with or without a disposal tank 32.

The baffle 22 is held at a distance from the back plate 14 by the bottom 21 and side wall 20. The baffle 22 serves several purposes. The baffle 22 forms a wall 22 as part of the reservoir 34 to hold liquid 36. The baffle 22 also contains liquid 36 from splashing away should it drop from the spout 40 and strike the back plate 14. Any liquid 36 splashing away from the back plate 14 is deflected toward the baffle 22.

When such airborne liquid 36 strikes the baffle 22, it is intercepted by the baffle 22 and drawn toward the bottom 21 by gravitational force. This may normally occur for spills or if a spout 40 is misaligned. However, in an alternative embodiment, the back plate 14 and baffle 22 may be sized and shaped to reverse roles such that the drips or spills intentionally strike the baffle 22. In this embodiment configuration, the baffle 22 may benefit from guides 18 to direct the liquid 36 toward the bottom 21. Guides 18 also serve to increase the section modulus (as that term is understood in engineering), stiffening any surface they are on. They may extend away as ridges or be formed as bends in the flat material.

The side walls 20 are attached to the back plate 14, the bottom 21, and the baffle 22 to create a reservoir 34 to hold liquid 36. Drops from the spout 40 that strike the back plate 14 have a tendency to splash. The side walls 20 prevent the splash from exiting the side of the drip catcher 10.

Figure 2:
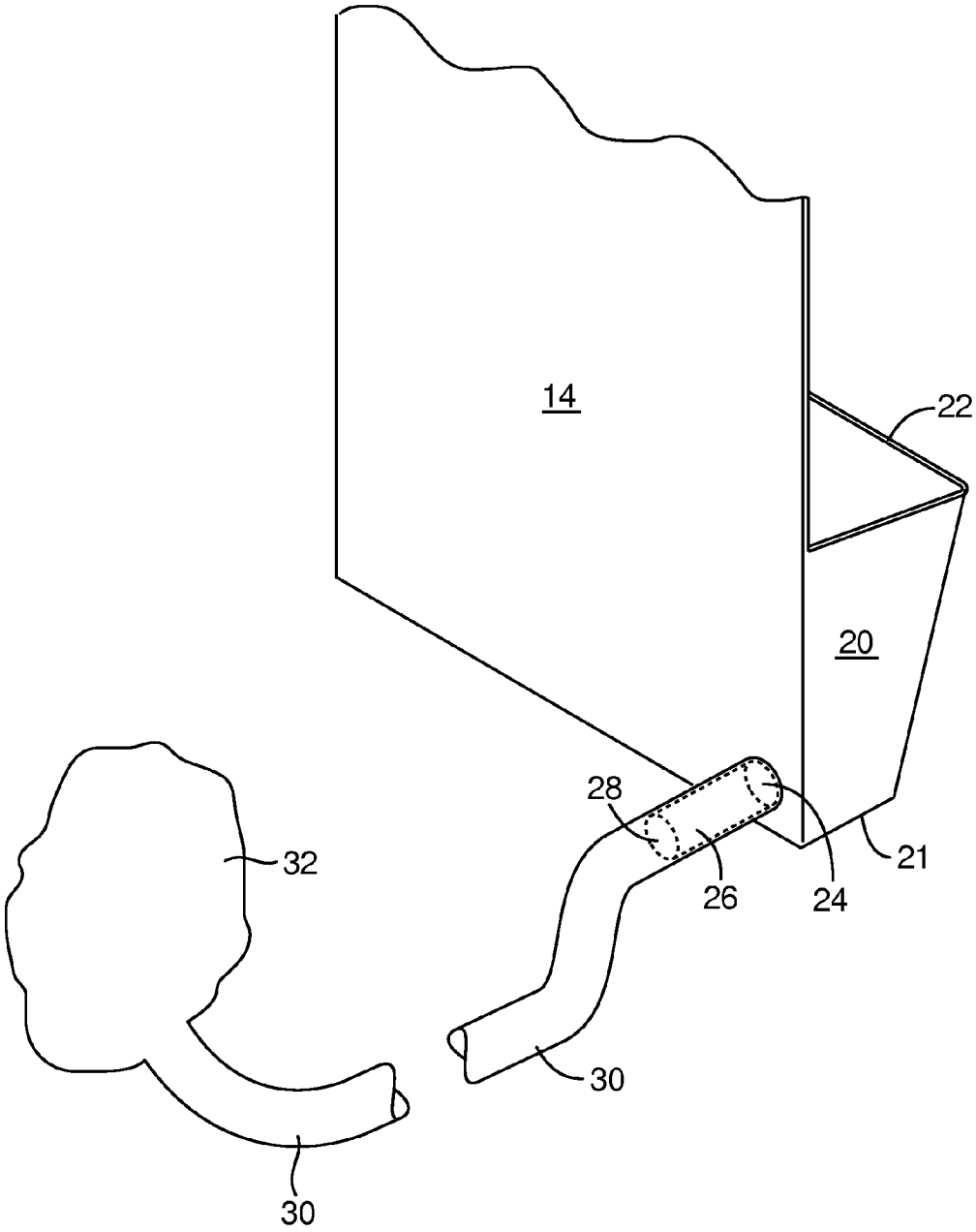
FIG. 2 is a rear elevation view of one embodiment of a system showing a port to drain fluid from a reservoir through a line to a disposal tank.

Referring to FIG. 2, a view of the drip catcher 10 from a rear angle shows the back plate 14 connecting to the bottom 21. A port 24 may be placed in the back plate 14, bottom 21, side wall 20, or baffle 22. The port 24 may be provided transition relief or contouring. It may simply proceed through the wall. The port 24 may connect to a fitting 26. The port 24 may allow for the attachment of a separate fitting 26 with an opening 28. Alternatively, a fitting 26 may be manufactured as a single piece with the port 24 as a part of the back plate 14. The fitting 26 may be a separate, flexible tube that has a lip that secures in and seals against the port 24. The fitting 26 may take any number of shapes so long as it allows for the passage of the liquid 36 through the port 24, fitting 26, and opening 28 to a line 30. The fitting 26 may optionally include a shutoff mechanism to control the flow of liquid 36 to the disposal tank 32 or vice versa.

The fitting 26 may operate with any of various types of couplings to connect the line 30 to the reservoir 34. The fitting 26 may be constructed as an express (quick-connect) coupling, cam and groove, a quarter turn coupling, a threaded coupling, a pressure fitting, or any similar construction. The fitting 26 may include or connect to a valve to inhibit the flow of liquid 36 from the reservoir 34, through the line 30, or both. The fitting 26 may also be constructed as a lip and groove constructed at one end of the line 30. The line 30 would then insert directly into the port 24 with the lip-and-groove forming a seal around the inside of the port 24. A grommet or other flexible, elastomeric fitting 26 may also serve.

The port 24 permits the liquid 36 to be drained from the reservoir 34 without having to remove the beverage dispenser 38 from the base 12 or move the drip catcher 10. This reduces the risk of spilling the liquid 36 stored in the reservoir 34 while emptying the drip catcher 10. Moreover, it may be advisable to keep the reservoir 34 effectively empty.

This also simplifies the disposal of the liquid 36. The disposal of the liquid 36 does not require moving the beverage dispenser 38 or drip catcher 10. Moving the beverage dispenser 38 may be difficult if the beverage dispenser 38 is full, heavy, hot, or any combination of the above. Moving the beverage dispenser 38 may also risks sloshing and spilling part of the contents. The beverage dispenser 38 may remain in use through out the time that the liquid 36 is removed.

The side walls 20 connect to the back 14, the bottom 21 and the baffle 22 to create a reservoir 34. The reservoir 34 collects liquid 36 that drips from the spout 40 or spills from a cup. In one embodiment, gravity may be a sufficient force to remove the liquid 36 from the reservoir 34. In an alternative embodiment, suction could be created via a pump or some other device to enhance the removal of the liquid 36 from the reservoir 34. The liquid 36 may drain out through the line 30 continually. Alternatively, an absorbent pad may be placed on the bottom 21. Alternatively, both may be used. Also, vertical guides 18 may extend upward from the bottom 21 as collimators to resist splashing.

A fitting 26 may be connected to the port 24 to connect a line 30. The fitting 26 may be constructed separately from and installed in the back plate 14. The back plate 14 and fitting 26 may be constructed as a single unit. Mold design and manufacturing considerations may dictate the configuration. Making the drip catcher 10 fit into a standard dishwasher is another consideration. The fitting 26 is to facilitate the connection of a line 30 to the reservoir 34. In one embodiment the fitting 26 creates a male connection for the line 30 sliding over the fitting 26. Any fitting 26 that provides a seal sufficient to prevent liquid 36 from escaping as it enters the line 30 may be used to connect the line 30 to the reservoir 34. A ferrule, ring, band, adhesive, elastomeric line 30 material, or the like may effect a seal. In another embodiment the fitting 26 may have a valve to allow the temporary shutoff of the liquid 36 in the reservoir 34 from entering the line 30 while the disposal tank 32 is being serviced. Alternatively, a check valve may prevent flow as soon as the line 30 is removed.

The line 30 serves as a conduit for moving the liquid 36 from the reservoir 34 to a disposal tank 32 without a risk of the liquid 36 being spilled. The conveyance of the liquid 36 through the line 30 may be done by a gravity feed, but may also be done by a pump creating suction to encourage the flow of the liquid 36.

The line 30 may include a shutoff mechanism such as a valve, plug, clamp, crimp, kink, or other device preventing the flow of liquid 36 through the line 30. The line 30 may be shut off to prevent the liquid 36 from the reservoir 34 from entering the disposal tank 32. In this manner, the disposal tank 32 may be serviced the liquid 36 being spilled. The line 30 also separates the disposal tank 32 from the reservoir 34. This allows the disposal tank 32 to be placed in an inconspicuous location that has lower traffic and lower visibility. The disposal tank 32 may be placed in an area that is not visible to individuals using the beverage dispenser.

The disposal tank 32 may take the form of a liquid collection box, bag, bucket, plastic jug, or any other device capable of storing liquid 36 until it is desirable to empty the device. As an alternative embodiment, a sink or drain may be used as a disposal tank 32. The sink or drain may dispose of the liquid 36 immediately. Also, the liquid 36 may flow immediately from the back 14 or baffle 22 into the reservoir 34, through the line 30, and into the disposal tank 32. The disposal tank 32 may contain an absorbent, such as a gelling agent.

Liquid 36 in the disposal tank 32 may be disposed of without moving the drip catcher 10 by sealing the line 30 with a valve in line 30, a valve in the fitting 26, or by limiting leakage from the spout while changing disposal tank 32. This allows for the removal of liquid 36 in the disposal tank 32 while the reservoir 34 remains available.

Figure 3:
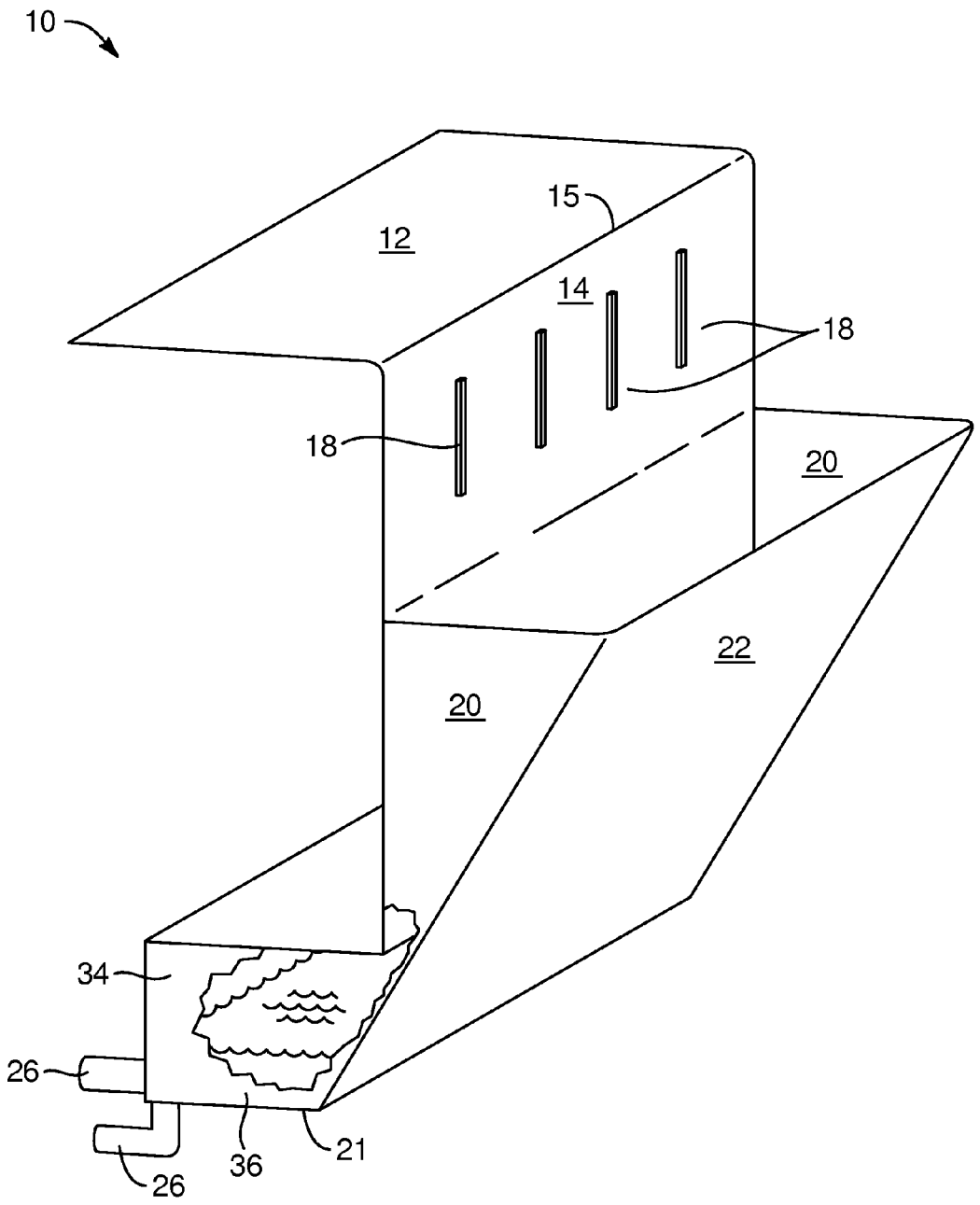
FIG. 3 is a front perspective view of one embodiment of a system showing an enhanced reservoir with alternative locations of a fitting to drain the reservoir.

FIG. 3 shows the drip catcher 10 with a base 12 connected to a back plate 14 and including guides 18 forming an edge 15. The back plate 14 is connected to side walls 20 and a bottom 21. The side walls 20 and the bottom 21 are connected to the baffle 22 to form a reservoir 34. The reservoir 34 collects liquid 36 immediately draining through the port 24 and fitting 26 into the line 30 to be stored in the disposal tank 32.

FIG. 3 shows an enhanced reservoir 34 to hold more liquid 36 that may accumulate while the disposal tank 32 is being changed. The enhanced reservoir 34 may also alter the balance of the drip catcher 10 to allow the drip catcher 10 to hang stably, with or without a beverage dispenser 38 on the base 12. The fitting 26 is shown attached to the back plate 14. In an alternative position, the fitting 26 is placed on the bottom 21 keeps the liquid 36 drained at all times. The liquid level is not required to rise to the level of a port 24 in the back plate 14. The fitting 26 may be of any suitable construction that connects the line 30 to the reservoir 34.

A recessed reservoir 34 may fit behind the back plate 14. Here, drops strike the baffle 22 prior to accumulating. This embodiment removes any liquid level access by falling drops or spills. It makes the drip catcher 10 less prone to splashing that may affect the user while the drip catcher 10 is misconfigured.

In an alternative embodiment, the baffle 22 may have a reversed role with respect to the back plate 14. The spout 40 may be configured so liquid 36 will first strike the baffle 22 rather than the back plate 14. In such a configuration, placements of the guides 18 on the baffle 22 are chosen to direct liquid 36 downward toward the bottom 21.

The port 24 may alternatively be placed in on of several different locations on the reservoir 34. The port 24 may alternatively be placed in the back plate 14, the bottom 21, the side walls 20, or in the baffle 22. The bottom 21 may be curved or slanted downward toward the port 24 to encourage the liquid 36 to not accumulate at all, but exit through the port 24. By encouraging the liquid 36 to flow toward the port 24, less liquid 36 will accumulate in the reservoir 34.

Figure 4:
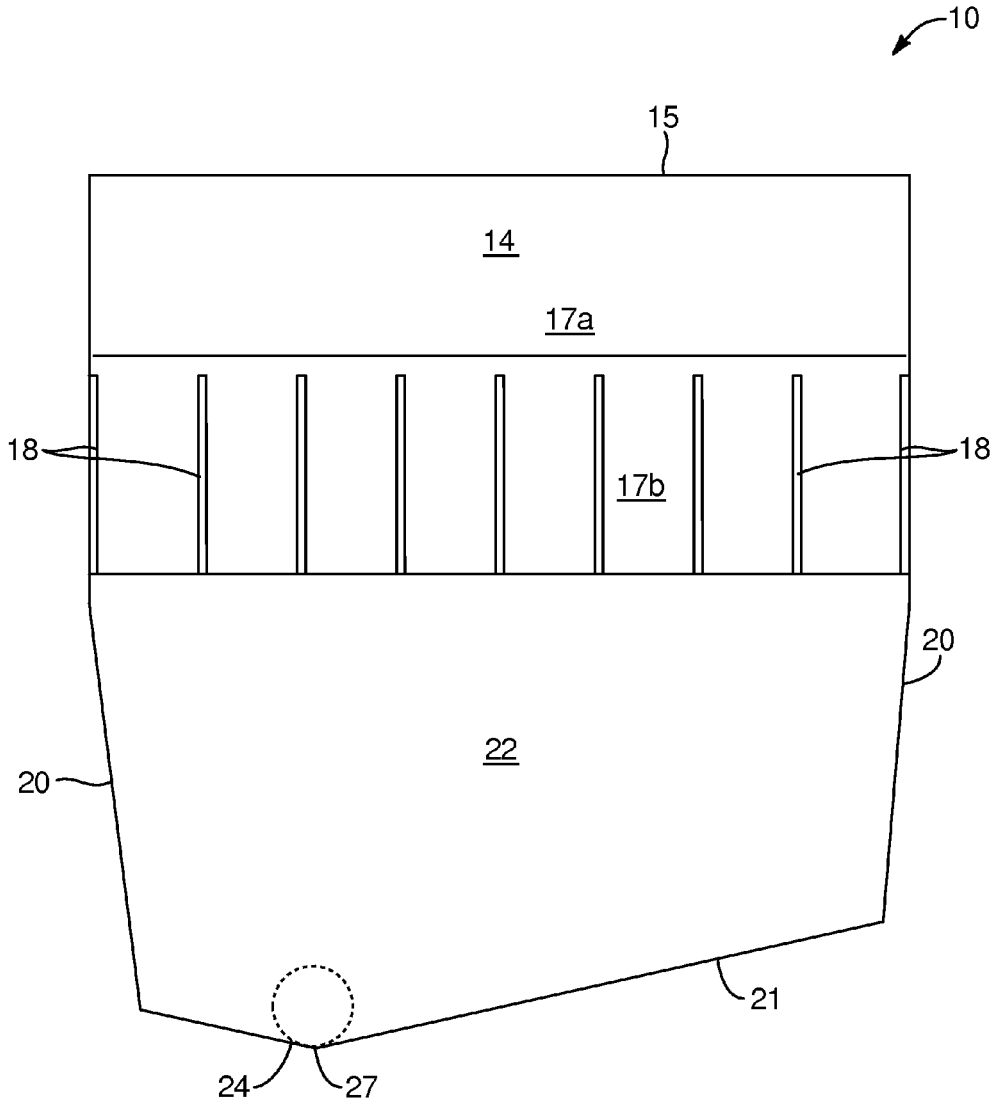
FIG. 4 is a front elevation view of one embodiment of a system showing hinges, front plate with guides, inclined bottom and port located at the low point of the reservoir.

FIG. 4 shows a front view with the hinges 16 visible and attached to the back plate 14. The hinges 16 may be placed on an interior or exterior surface of the drip catcher 10 for aesthetic reasons. The hinges 16 are optional and may be replaced by a permanent, non-moving connection or by a separable connection.

The hinge 16 placement on the outside surface of the drip catcher 10 may change the base plates 12 contact area with the table 42. The hinges 16 should not interfere with the base 12 contacting the table 42, destabilize the beverage dispenser 38, nor cause wear on the table 42.

The back plate 14 typically has guides 18 and is connected to side walls 20 and the bottom 21, which connect in turn to the baffle 22 to form a reservoir 34. The guides 18 aide in directing liquid 36 from the spout 40 downward toward the reservoir 34. The guides 18 also help to prevent spreading out by flows and help attenuate splashing off the back plate 14.

The base 12 connects to the back plate 14 to create an edge 15. The back plate 14 may be divided into two portions, a riser 17*a* and a catch zone 17*b*. The riser 17*a* creates a registration of the apparatus 10 against the table 42. The stability point prevents the apparatus 10 from being bumped or jostled out of position.

The catch zone 17*b* is angled so that when drips or spills strike, the liquid is drawn to it by surface tension without splashing. In one embodiment, the angle of the catch zone is approximately 30 degrees. The angle may vary depending on the configuration and size of the beverage dispenser 38, receiving cup, and spout 40. It may also depend on the type of liquid 36 being dispensed.

The guides 18 are constructed in the area of the back plate 14 that may be the optimal (e.g. targeted) area for a drop or spill to fall from the spout 40. In one embodiment, the area covered by the guides 18 need be only a small part of the back plate 14. An alternative embodiment may include the guides 18 distributed across the majority of the back plate 14, and possibly all of the width of the back plate 14. The guides 18 may also be distributed across the inside of the baffle 22. The presence of the guides where the drip or spill strikes the back plate 14 will help to prevent lateral splashing, spreading, or other movement of liquid 36 once the surface tension has caused the liquid 36 to adhere to the back plate 14. Guides 18 that cover a greater portion of the back plate 14 may service a wider range of configuration possibilities of the beverage dispenser 38.

The bottom 21 is shown slightly inclined to encourage collection toward the port 24. Liquid 36 will drain through the fitting 26 and line 30 into disposal tank 32. In an alternative embodiment, the lowest point on the bottom 21 or floor 21 may be offset or off-center toward one side of the drip catcher 10. The port 24 is positioned at the lowest corner or vertex 27. A concave bottom 21 or slanted bottom 21 with the port 24 at the lowest point encourages the liquid 36 to accumulate close to the port 24. By driving or urging the liquid 36 toward to the port 24, and placing the port 24 as the lowest surface, less liquid 36 ever accumulates in the reservoir 34. It drains immediately out the port 24, through the fitting 26 and line 30 into the disposal tank 32. The reservoir 34 allows a liquid 36 to accumulate if the fitting 26 or the line 30 has been shut off to change the disposal tank 32.

Figure 5:
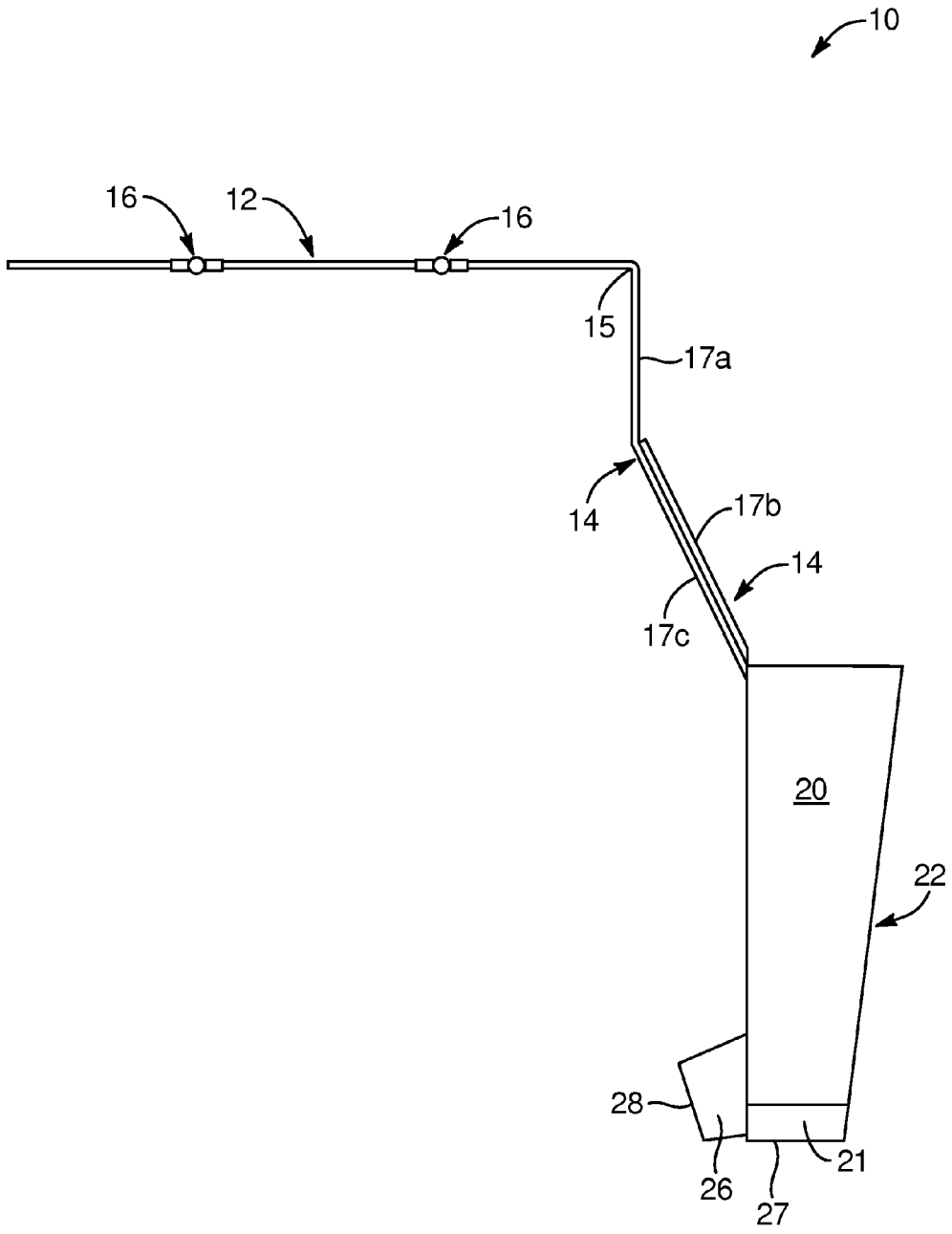
FIG. 5 is a side elevation view of the embodiment of FIG. 4 showing the base connected to a back plate by hinges, the back plate being slanted to provide easier configuration of the system, a reservoir, and a rear port to allow for the attachment of a line to drain the reservoir.

Referring to FIG. 5, the base 12 may be constructed as a single, solid piece of material, or it may be constructed from multiple, separate pieces. The separate pieces may be joined by a hinge 16. Any number or types of hinges 16, or a continuous hinge 16, may connect segments of the base 12. The hinge 16 may be made of any suitable, sufficiently strong material including an injection molded membrane of the base 12 material (e.g. live or integral polymeric hinge). Segments of the base 12 may also connect using an "H-clip," a tongue-and-slot connection, snap, slide or a flexible material capable of forming the connection.

The base 12 connects to the back plate 14 to form an edge 15. The back plate 14 shows a possible protrusion to allow any drips or spills striking it from or near the spout 40 to be directed toward the reservoir 34 by the guides 18. The protrusion provides enhanced access to the spout 40 by cups, mugs, or other vessels used to drink beverages from the beverage dispenser 38.

The back plate 14 is divided into two segments, the riser 17*a* and the catch zone 17*b*. The base 12 and riser 17*a* section of the back plate 14 position the apparatus 10 on a table 42 and stabilize to prevent accidental jostling.

The lower portion of the back plate 14 serves as a catch zone 17*b*. The catch zone 17*b* may connect to a separate portion of the back plate 14 that is configured as an angled receiver 17*c*. The catch zone 17*b* may be separably attached by tongue-and-slot, a snap, a hook-and-loop fastener, or any other securement mechanism suitable for securing the catch zone 17*b* to the angled receiver 17*c*. The catch zone 17*b* may detach from the angled receiver 17*c* to allow for convenient placement of the base 12 and the well 34 in a dishwasher.

The fitting 26 with an opening 28 is attached to the back plate 14 at or near the vertex 27 forming the lowest point in the reservoir 34. The connection of the line 30 to drain the liquid 36 from the reservoir 34 into the disposal tank 32. The draining of the reservoir 34 through the port 24, the fitting 26, and the line 30 into the disposal tank 32 removes the liquid 36 without moving the beverage dispenser 38.

Figure 6:
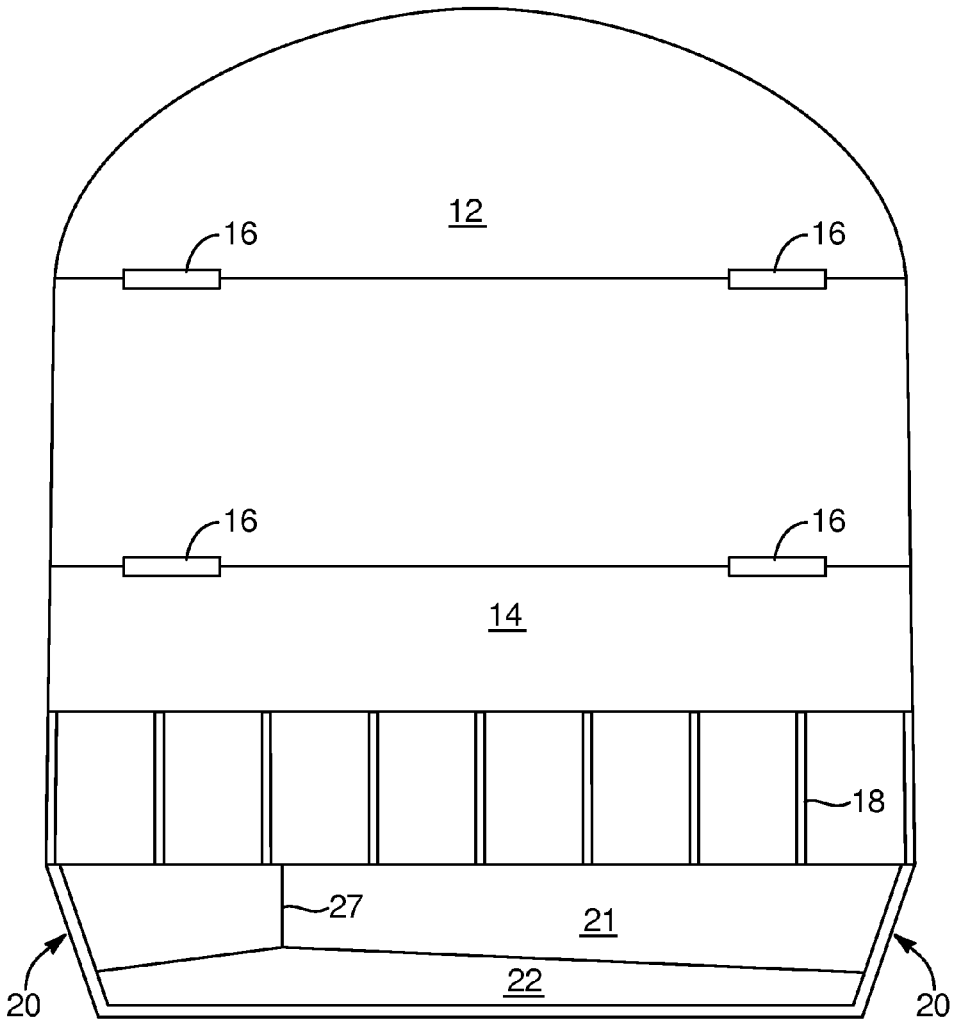
FIG. 6 is a top plan view of the embodiment of FIGS. 4 and 5 showing the base attached to the front plate with guides, and a top view of the reservoir with the baffle in the front and the port in the back plate.

Referring to FIG. 6, a top view of one embodiment of a system 10, the base 12 connects to the hinge 16, which is also connected to the back plate 14. The base may be constructed of multiple segments connected with hinges 16 (integrated or distinct) or other suitable fasteners. The beverage container 38 or other ballast may be placed on the base 12 to support the portion of weight of the device 10 below and spaced out away from the spout 40. The guides 18 direct drips from the spout 40 or spills from a cup toward the reservoir 34. The back plate 14 may project away from the base 12 to provide an enhanced strike area over the guides 18. The bottom 21 is curved to create a vortex 27 to aid the collection of the liquid 36 near the port 24 to enhance drainage.

Figure 7:
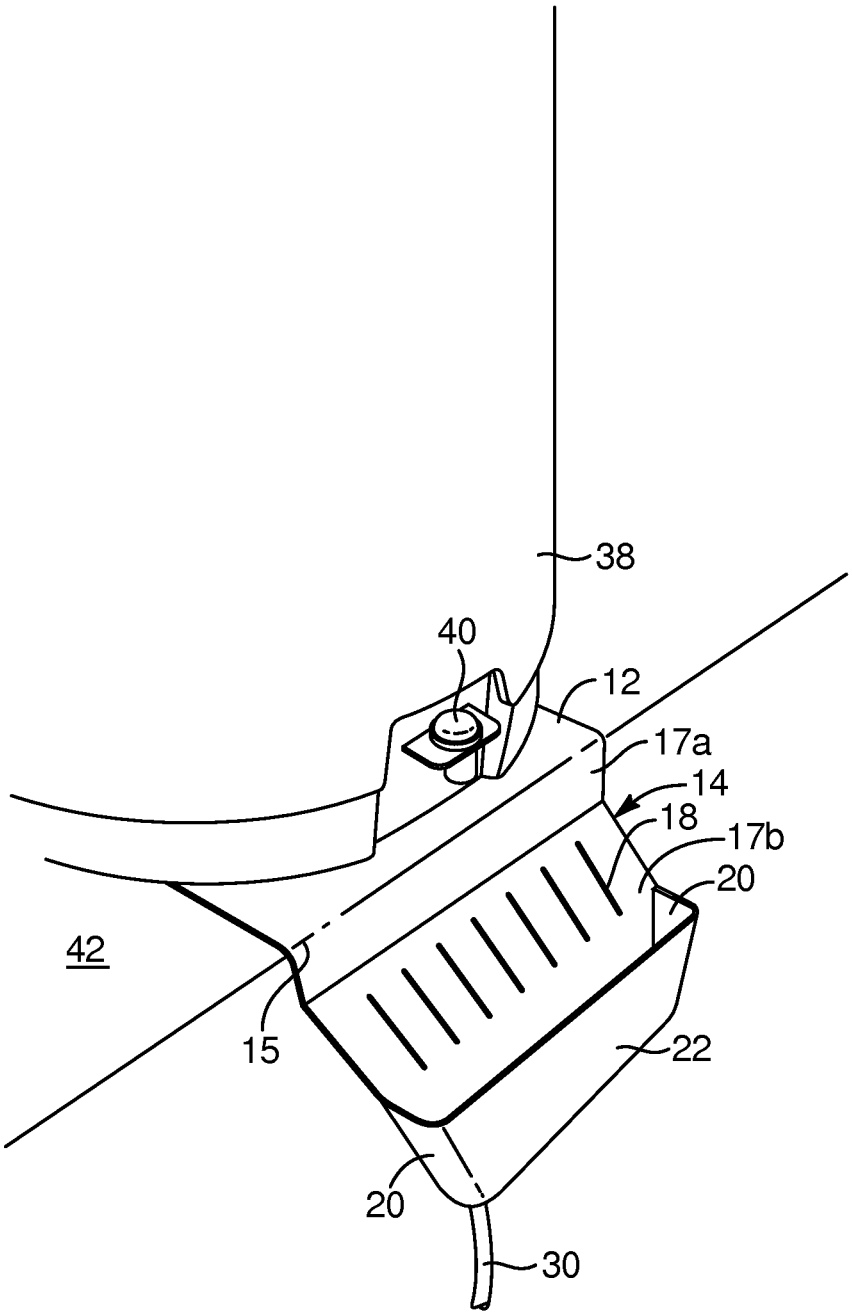
FIG. 7 is a frontal perspective view of an alternative embodiment of a system in use.
Figure 8:
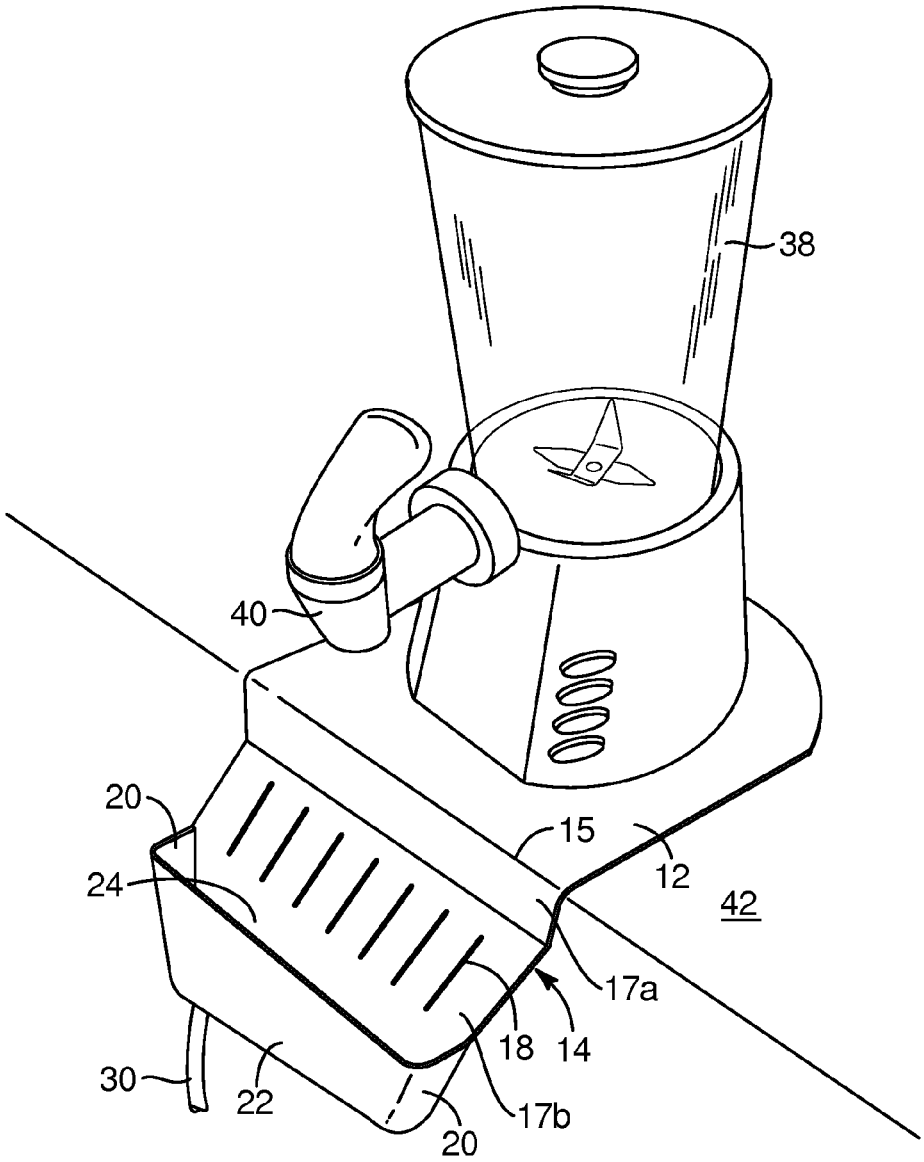
FIG. 8 is a frontal perspective view of the system with an alternative beverage dispenser.

Referring to FIG. 7 and FIG. 8, sample embodiments of the system 10 shows a beverage dispenser 38 placed on the base 12 located on a table 42 to support the drip catcher 10. The spout 40 is positioned over the back plate 14 and guides 18 so that liquid 36 released from the spout 40 that does not enter a cup will strike the back plate 14 and guides 18. The line 30 is shown carrying liquid 36 from the reservoir 34 to the disposal tank 32.

Figure 9:
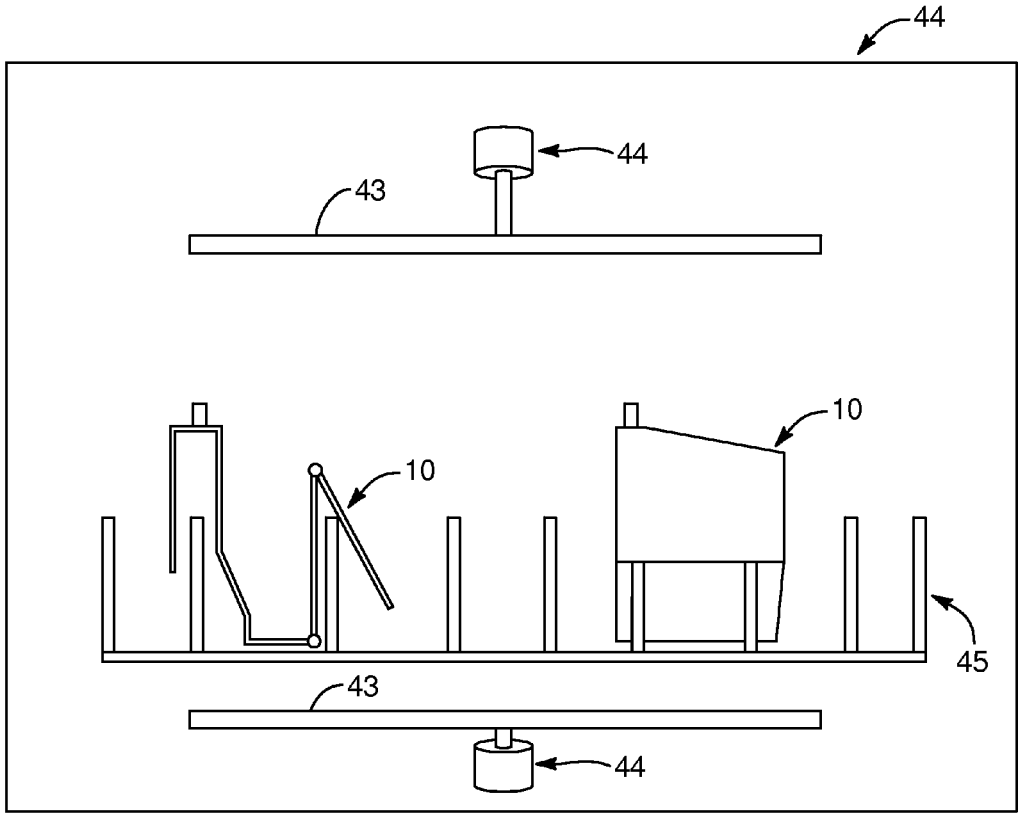
FIG. 9 is a front elevation view of one embodiment of the system in a household dishwasher.

Referring to FIG. 9, sample embodiments of the system 10 are placed in a dishwasher 44. One embodiment is shown from a front elevation view on the dishwasher rack 45. Another embodiment is shown as a side elevation cross-sectional view on the dishwasher rack 45. The side elevation view demonstrates that the reservoir 34 on the dishwasher rack 45. The base 12 has hinges 16 to allow the base 12 to fold to fit compactly for cleaning. The system 10 may be cleaned when the dishwasher arms 32 spray water. The dishwasher arms 43 may spin on the arm support 47 from water pressure providing cleaning spray over items in the dishwasher 44.

Figure 10:
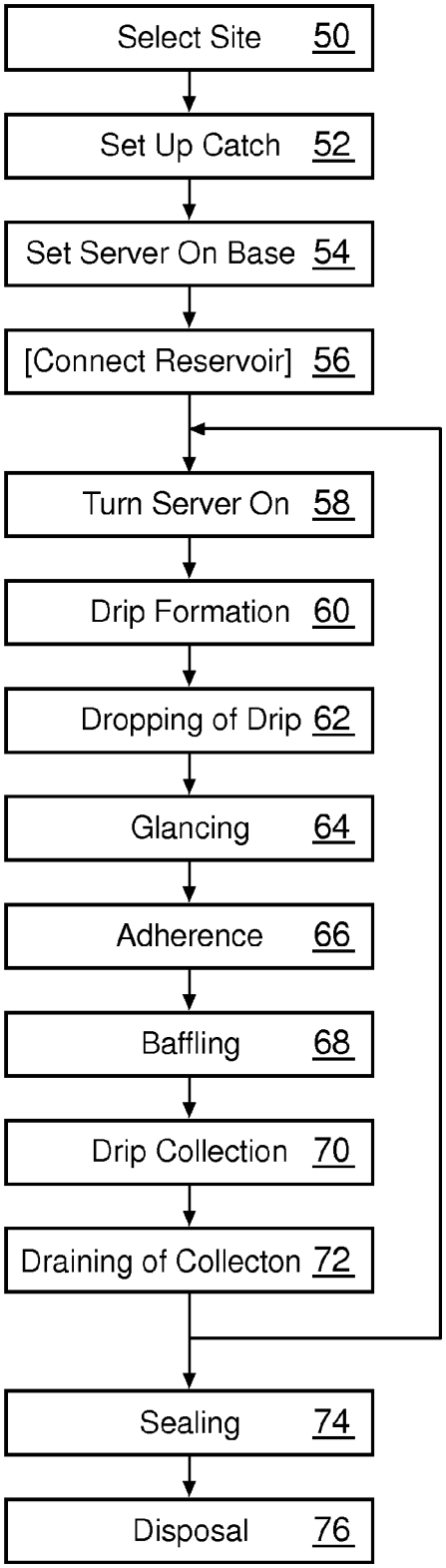
FIG. 10 is a schematic block diagram of a method whereby one embodiment of the system may be implemented and maintained.

Referring to FIG. 10, in one embodiment of a method 58 in accordance with the invention, one may select a site 50 to place one embodiment of the apparatus 10 and a beverage dispenser 38. Typically the site selected will be on a table 42, but may also be on a rack designed to hold the beverage dispenser 38, shelving, chair, or any other surface that can provide a stable support for the beverage dispenser 38.

Upon selecting the site 50, one may place the drip catcher 10 on a surface 42 or table 42 and then place the beverage dispenser 38 on the base 12. The beverage dispenser 38 may be placed 54 on the base 12 while it is full of beverage. It may be placed on the base 12 empty, and the beverage is added after placement 54 is complete.

The reservoir 34 is the connected 56 by attaching the line 30 to the fitting 26. The line 30 is constructed to convey liquid 36, and may be flexible to accommodate a variety of configurations and relative positions of the reservoir 34 and disposal tank 32. Materials may include rubber, vinyl, latex, or any other suitable material capable of containing a liquid 36 passing through the line 30. The other end of the line 30 is connected to the disposal tank 32. The disposal tank 32 may include a sealed bag 32, bottle 32, or other container with a fitting to completely enclose and seal in the fluid. Other devices may be suitable for the separate storage of liquid 36.

Turning on 58 the beverage container 38 allows individuals to obtain the beverage. The beverage container 38 may then be used by a large number of individuals, each obtaining a drink without requiring users to behave differently. Individual users will be able to see the drip catcher 10, but are not required to have any knowledge of how the drip catcher 10 works.

Drips form 60 inside of the spout 40 because fluid exiting the spout 40 tends to adhere to the walls of the spout 40 due to surface tension. While most of the liquid 36 does exit the spout 40, some remaining liquid 36 adheres to the spout 40. The liquid 36 remaining in the spout then tends to collect around the lowest point of the spout 40 due to the surface tension bond between the liquid 36 exceeding the surface tension bond with the inside of the spout 40. When sufficient liquid 36 has coalesced to form a drop large enough that the gravitational pull against the drop exceeds the surface tension of the drop, the drop will fall.

Drips can also form 60 due to imperfections in the valve for the beverage dispenser 38. Liquid 36 may escape through the valve due to imperfections in the valve. These imperfections may be the result of the design, the result of wear and tear, or due to the pressure of the liquid 36 and a different surface tension of the liquid 36 in the beverage dispenser 38 than the designer expected. A large number of drips may form 60 if an individual fails to keep a container under the spout 40 the entire time the valve is open.

A spill may occur when a user of the beverage dispenser 38 is inattentive and overfills the cup, glass, mug or other beverage container. A spill may also occur if the user fills the beverage container and catches the lip of the beverage container on the spout 40 causing the liquid 36 to slosh and splash. The release of this liquid may be less orderly than a drip, and may also release a greater amount of liquid 36. A larger back plate 14, reservoir 34, or both may be advantageous to contain these spills.

As the drip falls 62, the velocity of the drip increases at a rate of the gravitational constant. Velocity is that constant times the time the drip has been falling. Typically on earth the gravitational constant is approximately 9.8 meters per second. As a result, the longer the drop falls, the higher the velocity of the drop. The drop will approach the back plate 14. The back plate will usually be configured such that the glancing (oblique) angle is very small (acute). A small glancing angle allows the drop to fall freely and slightly closer to the back plate 14 as it falls. Eventually, the drop will come into contact with the back plate 14.

The drop will adhere 66 to the back plate 14 due to the surface tension between the back plate 14 and the liquid 36. The combination of the surface tension and the gravitational pull against the slanted back plate 14 will cause the drop to flatten and adhere to the back plate. When the angle of the back plate is appropriately configured the drop of liquid 36 will not splash, nor have any appreciable fraction of the liquid 36 be released from the adherence to the back plate 14. Surface tension of the liquid 36 exceeds the kinetic energy pushing the drop away from the back plate 14. The drop will then travel down the back plate due to inertia and gravitational pull in a rivulet.

The guides 18 increase the surface area of the back plate 14, increasing the amount of surface tension between the back plate 14 and the liquid 36. Guides 18 also resists the rivulets varying direction due to imperfections in the back plate 14 or contaminants, such as soap, oil, or the like on the back plate.

In the event that a drop strikes an existing amount of liquid 36, the guides 18 also serve to resist lateral flow caused by drops striking small amounts of liquid 36 adhering to the back plate 14. Failure to control lateral flow could result in liquid 36 leaving the back plate 14 laterally, rather than descending into the reservoir 34.

Baffling 68 prevents small amounts of splash from apparatus 10 having a glancing angle that is to large. The drop will develop inertia as it falls downward. This inertia will also tend to drive any splash to continue in the same generally downward direction. The baffle 22 on the front of the drip catcher 10 will further resists liquid 36 escaping the drip catcher 10.

Drip and spill collection 70 develops in the reservoir 34 as liquid 36 descends down the back plate 14. Gravitational pull will continue to draw the liquid 36 toward the lowest point of the reservoir 34. Over time, this liquid 36 may accumulate. The fluid 36 may build until the liquid level reaches the port 24, unless the port 24 is at least as low as the floor 21 or bottom 21.

Draining 72 the liquid 36 occurs when its level is sufficient to reach the port 24. In one embodiment of the drip catcher 10 is drained using gravitational pull, liquid 36 would drain into the port 24 when the gravitational pull against the liquid 36 exceeded the surface tension of the liquid 36. In a different embodiment suction may be used to drain the reservoir 34, so the liquid 36 would drain when the suction was greater than the surface tension.

Sealing 74 the disposal tank 32 prepares it to be changed out without liquid 36 being released. The disposal tank 32 may be sealed by closing off the line 30 near the port 24 or at some other point during the line 30. This may be done by a valve, plug, clamp, or by kinking the line 30 to the point of collapse. The disposal tank 32 may need a cap or plug placed on or in any fitting used to attach the line 30 to it. A replacement disposal tank 32 may be installed by connecting a new disposal tank 56.

Disposal 76 or final disposition 76 of the liquid 36 in the disposal tank 32 may then safely occur at a convenient location by moving the full disposal tank 32 to an appropriate location and disposing of the liquid 36 in accordance with local laws and reasonable business practices. Disposal of the liquid 36 in the disposal tank 32 may occur by emptying the contents of the disposal tank 32 into a sink or other sewage for appropriate disposition.

Hinges in the invention may be made as separable portions of components that "click" together. They may instead use a conventional rod running between apertures through alternating extensions from the adjacent pieces being hinged together. Separate hinges may be fastened to two components to hinge them together. Alternatively, parts may be molded to connect through a living hinge (hinge integral with and homogeneous with the base material), such as a thin portion of a molded part.

This may typically be made by passing liquified resin (e.g., injection molded) from the thicker structural region through an intervening, much thinner, hinge region. This is done to orient a thinned cross sectional area of the long polymer chains (molecules), thereby increasing the toughness or strength per unit cross sectional area, despite the thinning of the cross section. The thin cross section may thus bend repeatedly as a hinge, having a reduced section modulus (as that term is understood in structural engineering), yet remain attached without breaking.

In alternative embodiments, the reservoir 30 may be a flexible (e.g., plastic, liquid-proof, or the like) bag or other container secured by a ligature. The ligature may be any suitable stranded material, such as a band, belt, loop, elastic wrap, or wire tie urging contact of the bag against a flexible liner on the fitting 26, which may be oriented vertically or horizontally. It has been found that a flanged end on the fitting 26 prevents or resists slippage, especially in a vertical orientation.

The ligature (e.g., wire tie, elastic band, etc.) may secure a flexible bag or other container for mechanical support of its weight as well as for purposes of sealing the flow of waste thereinto. It may be deployed around an opening in the bag, which contacts the outside perimeter of the flexible liner (e.g., an elastomeric tube or sleeve around the fitting 26). Deflection of the flexible liner effectively embeds the ligature and flexible bag into the flexible liner (e.g., elastomeric sleeve), thereby resisting slippage of the flexible bag from the fitting 26.

Also, any of the plate like portions of the system 10 may be made separable at a joint on or near any change of direction. Joints may be pivotable, but may also be rigid, such as by sliding together in one dimension within the plane and parallel to the length of the joint, but fixed against movement in the remaining two dimensions. For example, this may include the base 12, back plate 14, collection reservoir 34, or any combination or sub-combination thereof. Likewise, any planar portion may be stiffened by ribs or a sidewall at an edge thereof.

Meanwhile, joints for fixing components in rigid relation to one another may include dovetail inserts with mating ways, rectangular fittings operating as slides in keepers shaped to prevent relative rotation while permitting sliding engagement and disengagement and so forth. Any registration shape may be used in the cross section of mating portions, whether triangular, uni-angular, polygonal, or the like. Securement may be by tethers, locks, catches, latches, or snaps rather than slides. However, the slides enable homogenous molding and easy disassembly for automatic cleaning in a common dishwasher without the risk of losing or damaging small parts.

What is claimed and desired to be secured by United States Letters Patent is:

1. A method comprising:

selecting a support for a beverage dispenser, the support having an upper surface;

providing a catcher, structurally distinct from, independent from, and selectively positionable on and removable from the support, the catcher comprising a base protecting a supporting surface under the beverage dispenser, a back connected to depend from the base and defining a planar surface positioned to conduct liquid away from the base, a baffle juxtaposed opposite the back and extending upwardly a distance effective to reflect, adhere, or otherwise capture splashing from the back, a bottom connected to the back and the baffle to form a liquid-containment reservoir therewith, the catcher defining a lateral direction, corresponding to a width of the beverage dispenser, a vertical direction, and a transverse direction orthogonal to the lateral and vertical directions, the catcher having a lateral width, corresponding to the width of the beverage dispenser and extending transversely and vertically to the bottom, the base, back, and bottom constituting a flow path continuous, contiguous, and sealed to conduct a portion of the liquid impinging substantially anywhere within the lateral width thereon toward the reservoir, and a port operably connected to drain the reservoir;

selecting the beverage dispenser having a spout comprising at least one of a pipe, tube, and projection configured to accomplish at least one of discharging, pouring, and conveying a liquid;

positioning the base on the upper surface;

positioning the beverage dispenser on the base so as to position the spout over at least one of the back and the baffle;

dispensing at least a portion of the liquid from the dispenser through the spout;

collecting, by the catcher, into the reservoir, waste comprising at least one of a spill and a drip of the liquid by intercepting the liquid on at least one of the back and the baffle; and draining the reservoir through the port;

wherein at least one of the back and the baffle is provided with guides constructed to restrict motion laterally by the waste, the guides comprising a plurality of ridges protruding upwardly from the planar surface of the back, the planar surface extending outwardly on either side of the plurality of ridges.

2. The method of claim 1, further comprising:

providing a storage container located remotely from the reservoir to receive by gravity feed a content of the reservoir, the storage container being selectively connectable and separable from the reservoir as a receptacle and as a disposal container, respectively; and connecting the storage container to the port.

3. The method of claim 2, further comprising:

providing a fitting shaped to connect to the port;

providing a line for carrying liquid between the fitting and the storage container; and passing at least a portion of collected liquid from the reservoir to the storage container through the line.

4. The method of claim 1, wherein the back connects to the baffle by at least one of a side, a plurality of sides, and curvature of at least one of the baffle and the back, and the baffle extends past the back to a position therebehind effectively obscuring from view and from direct splashing contact the reservoir.

5. The method of claim 3, wherein the back, baffle, and bottom are formed of a single, continuous, homogenously molded material.

6. The method of claim 1, further comprising:

positioning the catcher in an automatic dishwasher; and cleaning the catcher by operating the automatic dishwasher.

7. The method of claim 1, wherein the catcher further comprises:

a fitting creating an attachment for a line to the port;

the line, shaped and directed to drain fluid from the port;

a storage container connected to receive the fluid from the line, and a seal selectively sealing at least one of the reservoir and the storage container from one another to support continued operation of the reservoir during disposal of the contents of the storage container.

8. The method of claim 1, further comprising:

providing a registration portion extending directly vertically from the base to a remainder of the back and serving as a registration device registering the catcher with respect to a supporting surface therebelow; and selecting an angle of extension between the remainder of the back and the base, based on at least one of surface tension between the waste and the catcher, kinetic energy of the waste, and the position of the spout with respect to at least one of the back and the baffle.

9. The method of claim 1, wherein the baffle is angled to direct downward splashing of waste proceeding transversely from both the back and the baffle and the bottom is not directly impinged by a vertical line from the spout.

10. The method of claim 1 further comprising:

provide a storage container;

positioning an absorbent in the storage container;

connecting the storage container to the port;

draining the waste from the reservoir to the storage container;

absorbing the waste in the absorbent; and disposing of the waste by at least one of replacing the absorbent in the storage container, and disposing of the storage container with the absorbent therein.

11. The method of claim 1, wherein:

the base is connected to the back by at least one of a hinge, selectively separable connector, or permanent connector;

the hinge is selected from a distinct structure secured to the back and the base, and a molded continuous, contiguous, homogeneous structure of the catcher; and the beverage dispenser is placed on the base such that waste from the spout strikes the back.

12. A device for collecting at least a portion of an amount of a liquid originating from a source containing the liquid, the device comprising:

a base protecting a support surface under the source and supporting thereon the source;

a back defining a first surface to receive from the source at least a portion of the liquid thereon;

a baffle;

a bottom, forming, with the back and the baffle, a reservoir;

the base, back, and bottom defining a vertical direction, lateral direction, and transverse direction, mutually orthogonal to one another, with the base extending in the lateral direction and the transverse direction;

the source of liquid defining a total width thereof extending in the lateral direction;

the base, back, bottom, and baffle extending laterally and continuously a catch width corresponding to the total width; and a port for draining waste from the reservoir without removal of the device from service.

13. The device of claim 12, further comprising:

a fitting adapted to connect to the port;

a line connected to the port;

a disposal tank connected to receive the waste through the line.

14. The device of claim 12, further comprising a connection between the back and the base, the connection being selected from a continuous and homogeneously molded hinge, an attached hinge, and joint selectively separable to disconnect the base from the back.

15. The device of claim 12, wherein the back comprises:

a vertical back defining a vertical surface to receive waste deposited vertically thereon; and an angled back defining the first surface, an upper edge of the angled back secured to a lower edge of the vertical back, the angled back being angled outwardly from the vertical surface.

* * * * *